United States Patent [19]

Maras

[11] Patent Number: 4,899,646

[45] Date of Patent: Feb. 13, 1990

[54] WINDOW RAIN GUARD

[75] Inventor: Henry S. Maras, Hamburg, N.Y.

[73] Assignee: H.S.M. Concepts, Hamburg, N.Y.

[21] Appl. No.: 305,551

[22] Filed: Feb. 3, 1989

[51] Int. Cl.[4] ..... E06B 7/02

[52] U.S. Cl. ..... 98/99.1

[58] Field of Search ..... 98/44, 99.01, 99.1, 98/99.6

[56] References Cited

U.S. PATENT DOCUMENTS

| | | | |
|---|---|---|---|
| D. 201,071 | 5/1965 | Faubion | D 13/1 |
| D. 265,591 | 7/1982 | Kearnes | D25/54 |
| 1,509,052 | 9/1924 | McGaughey | 98/88.1 |
| 1,810,824 | 6/1931 | Frederick | 98/99.1 |
| 2,079,590 | 5/1937 | Armstrong | 98/99.1 |
| 2,179,541 | 11/1939 | Burke | 98/99.1 X |
| 2,247,947 | 7/1941 | Henderson | 98/88.1 |
| 2,364,271 | 12/1944 | Carver | 98/121 |
| 2,389,509 | 11/1945 | Hellman | 98/96 |
| 2,398,762 | 4/1946 | Amiot | 98/99.1 |
| 2,537,861 | 1/1951 | Routson | 98/44 |
| 2,561,928 | 7/1951 | Johnston | 219/34 |
| 2,604,839 | 7/1952 | Rasmus et al. | 98/99.1 |
| 2,706,443 | 4/1955 | Meador | 98/99.1 |
| 2,881,691 | 4/1959 | Barlow | 98/99.01 |
| 3,523,501 | 8/1970 | Willert | 98/99.1 |
| 3,844,076 | 10/1974 | Shöck | 52/107 |
| 4,765,110 | 8/1988 | MacLeod | 52/473 |

*Primary Examiner*—Harold Joyce

*Attorney, Agent, or Firm*—Marjama & Pincelli

[57] ABSTRACT

A rain guard for use with a triple track storm window. The rain guard comprises a generally rectangular body made of a plastic material having top edge, bottom edge and a pair of vertical edges. The body has top flange along its top edge, a pair of vertical flanges along its vertical edges and a dome section extending from the flanges to the bottom edge. The body is designed such that the vertical flanges will fit within one of the tracks of a triple track storm window.

37 Claims, 5 Drawing Sheets

WINDOW RAIN GUARD

BACKGROUND OF THE INVENTION

The present invention is directed to a window rain guard or ventilator, and more particularly, for a rain guard for use with a triple track storm window.

Various rain guards or window ventilators have been suggested in the prior art. These devices are typically designed to be used directly with a permanent window. Examples of such prior art devices are illustrated by U.S. Pat. Nos. 2,604,839; 2,561,928; 22,398,762; and 1,509,052. A major disadvantage with these type devices is that they must be removed from the window in order to lock the window, or some additional mechanism is required to lock the window in place while the ventilator is in use. An additional problem with such devices is that in order to accommodate various sizes of windows, additional structural elements have been required to allow for size adjustments. This, of course, increases the cost of such devices. Further, these additional structure elements make it more difficult to install and remove the device.

Applicant has invented a rain guard for use with a storm window which does not disturb the security of the permanent window, is easy to install, and is capable of easily being adjusted to fit a variety of different size storm windows.

SUMMARY OF THE INVENTION

In accordance with the present invention there is provided a rain guard for use with a triple track storm window. The rain guard comprises a generally rectangular body made of a plastic material having top edge, bottom edge and a pair of vertical edges. The body has top flange along its top edge, a pair of vertical flanges along its vertical edges and a dome section extending from said flanges to said bottom edge. The body is flexible so that the vertical flanges can be fitted within one of the tracks of a triple track storm window.

DETAILED DESCRIPTION OF THE INVENTION

Figure 1:
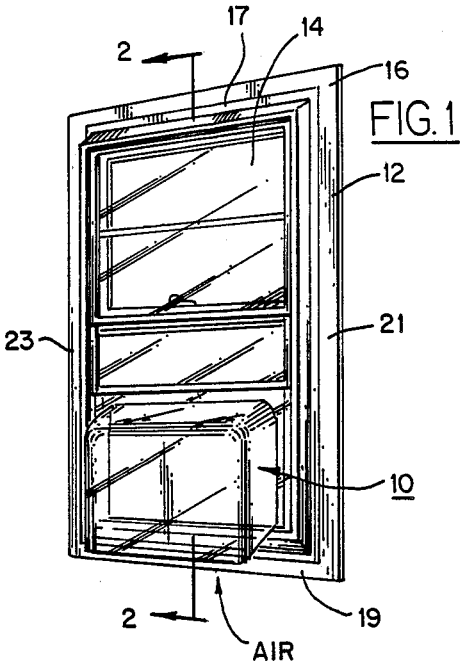
FIG. 1 is a perspective view of a storm window mounted adjacent a permanent window having a rain guard made in accordance with the present invention mounted to the storm window.
Figure 2A:
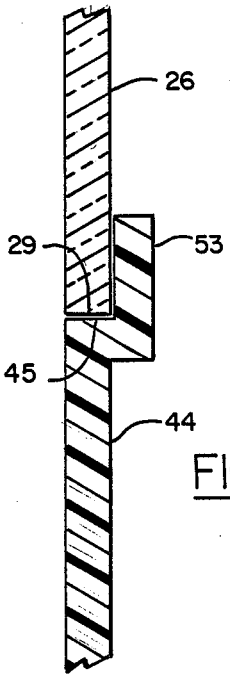
FIG. 2A is an enlarged view of that portion circled in FIG. 2 identified by line 2A.
Figure 2:
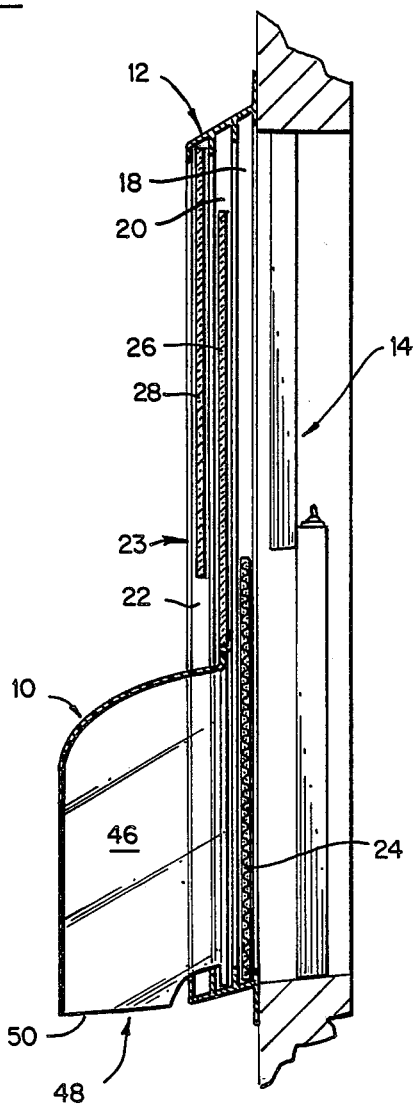
FIG. 2 is a cross-sectional view of the permanent window, storm window and rain guard of the present invention as taken along line 2—2 thereof.

Referring to FIGS. 1–6, there is illustrated a rain guard 10 made in accordance with the present invention. Referring in particular to FIGS. 1 and 2, the rain guard 10 is illustrated mounted to a triple track storm window 12 which is mounted adjacent a standard permanent window 14. The triple track storm window 12 is typical of such prior art devices presently available and comprises a generally rectangular metal frame 16 having a top support 17, bottom support 19, right vertical support 21 and left vertical support 23. Three parallel tracks 18, 20, 22 are provided on the inside surface of right and left vertical supports 21, 23 for placement of storm windows and a screen. Generally, the inner track 18, the track closest to the window 14, is provided with a screen 24 which is slidable mounted within inner track 18. Means for locking the screen at various locations along its height is provided as is customarily done in the prior art. Slidable mounted within middle track 20 and outer track 22 are storm windows 26 and 28 respectively. Means are also provided for positioning the windows 26, 28 at various vertical positions within their respective track. Typically, the screen 24 is positioned in the lower bottom half of the storm window 12 as illustrated in FIG. 2. The storm window 28 in outer track 22 is typically positioned in the upper half of the storm window as illustrated. The storm window 26 in center track 20 is typically in the lower bottom half of the frame 16 adjacent to the normal position of the screen 24. In the normal operation of triple track storm window 12, the storm window 26 is lifted up to allow air to enter into the house or building. As illustrated in the FIG. 2, the rain guard 10 is mounted in the lower half of the center track 20. Accordingly, the storm window 26 is positioned in the upward half of storm window 12 so as to accommodate installation of the rain guard 10.

Figure 4:
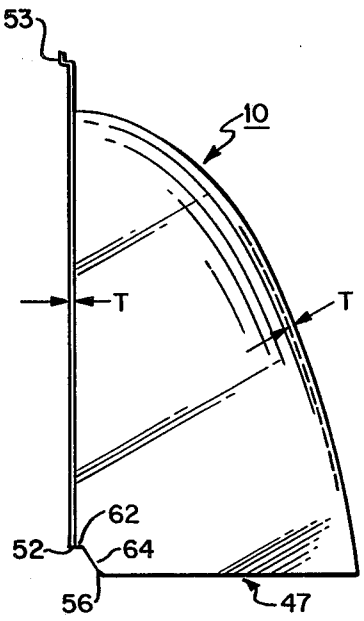
FIG. 4 is a side elevational view of the rain guard of FIG. 3.
Figure 3:
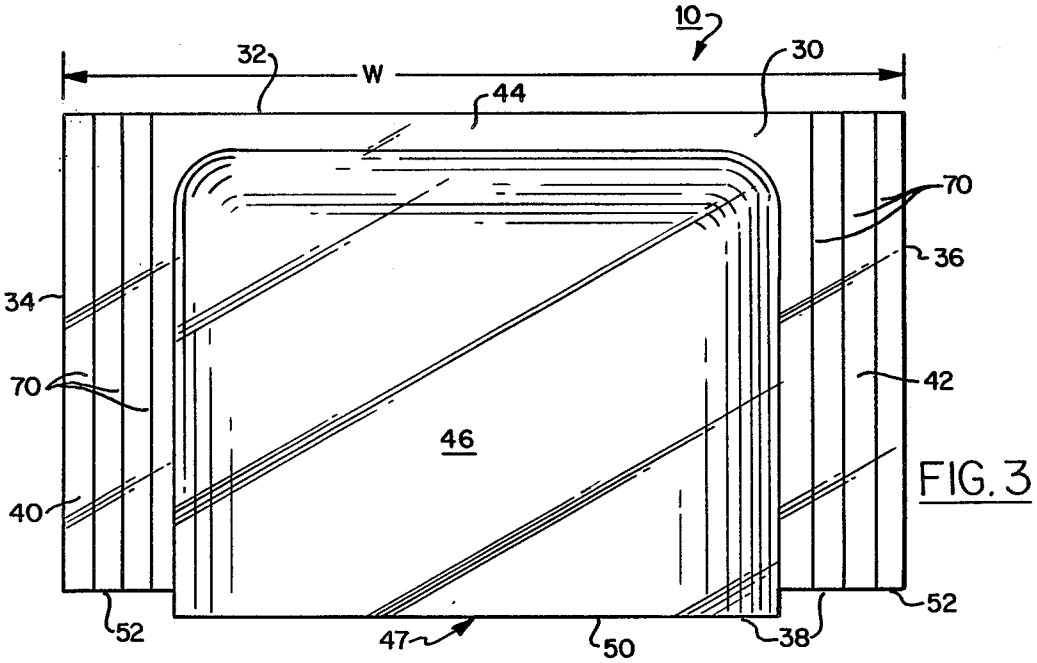
FIG. 3 is a front elevational view of the rain guard of FIG. 1 prior to installation.
Figure 5:
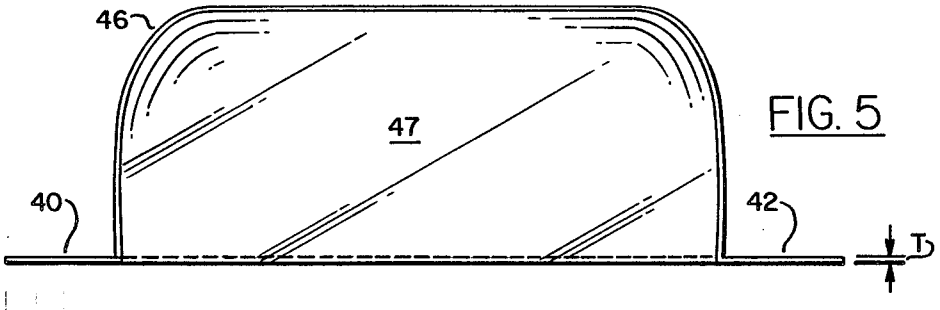
FIG. 5 is a bottom plan view of the rain guard of FIG. 3.

Referring to FIGS. 3–5, there is illustrated the rain guard 10 in more detail prior to mounting. Rain guard 10 is made of a clear plastic material and comprises a generally rectangular unitary body 30 having a top edge 32, a pair of side edges 34, 36 and a bottom edge 38. The unitary body 30 further comprises a pair of axially opposed vertical flanges 40, 42 along side edges 34, 36 and a top flange 44 along the top edge 32 which connects flanges 40, 42. Flanges, 40, 42, 44 all lie in the same plane so as to correspond to one of the tracks of storm window 12. The vertical flanges 40, 42 are preferably designed to be placed within middle track 20. Body 30 further includes a dome section 46 which extends away from flanges 40, 42, 44 to bottom edge 38 so as to provide an access opening 47 to allow air to enter at the bottom as illustrated while minimizing or preventing rain from entering into the building. In the particular embodiment illustrated, the bottom edge 50 of the dome section 46 extends to a point which corresponds approximately to bottom edge 52 of vertical flanges 40, 42. This configuration would minimize or prevent rain from entering even in a strong cross wind. However, it is to be understood that bottom edge 50 may terminate either at a higher or lower point as desired.

Figure 11:
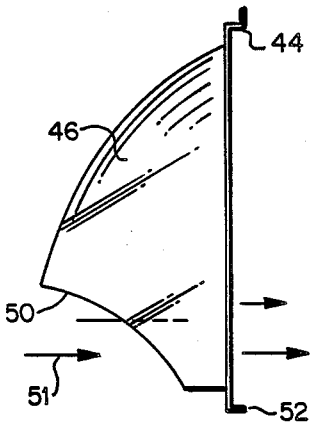
FIG. 11 is a side elevational view of a modified rain guard made in accordance with the present invention.
Figure 12:
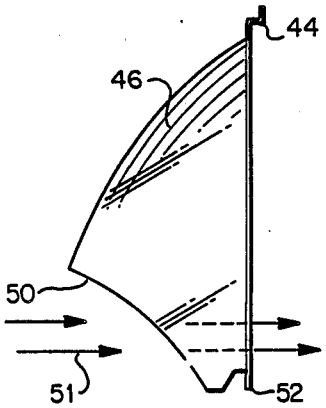
FIG. 12 is a side elevational view of yet another modified rain guard made in accordance with the present invention.
Figure 13:
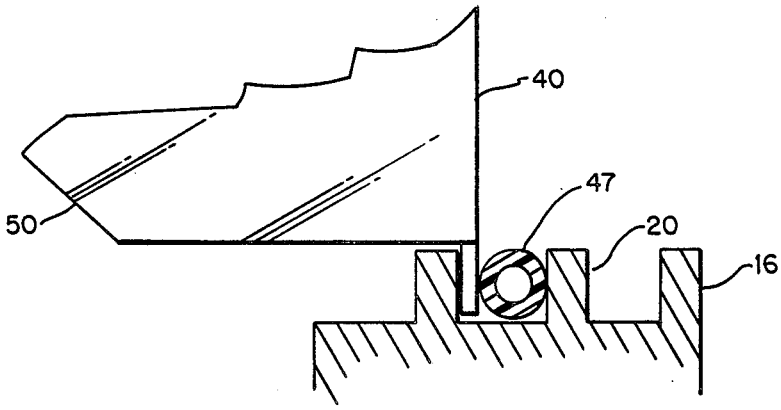
FIG. 13 is an enlarged partial side elevational view of the rain guard of FIG. 11 installed in a storm window.

Referring to FIGS. 11 and 12, there is illustrated side an elevational view of two modified rain guards made in accordance with the present invention, like numerals indicating like parts. In these embodiments the bottom edge 50 of dome 46 is above the bottom edge 52 of flanges 40, 42 so as to provide direct flow of air through the windows as indicated by arrows 51.

Referring back to FIGS. 2 and 2A, the vertical flanges 40, 42 are placed within the middle track 20. The middle storm window 26 is positioned in track 20 so that the bottom edge 29 of storm window 26 contacts the upper edge 45 of top flange 44. Preferably, as illustrated in FIG. 2A, the top flange 44 is provided with an upwardly extending lip 53 which extends the length of the flange 44. Lip 53 is offset axially inward toward window 14 and engages the inside of the bottom edge 29 of storm window 26. Lip 53 assists in preventing the entrance of rain or other elements between rain guard 10 and storm window 28.

Figure 6:
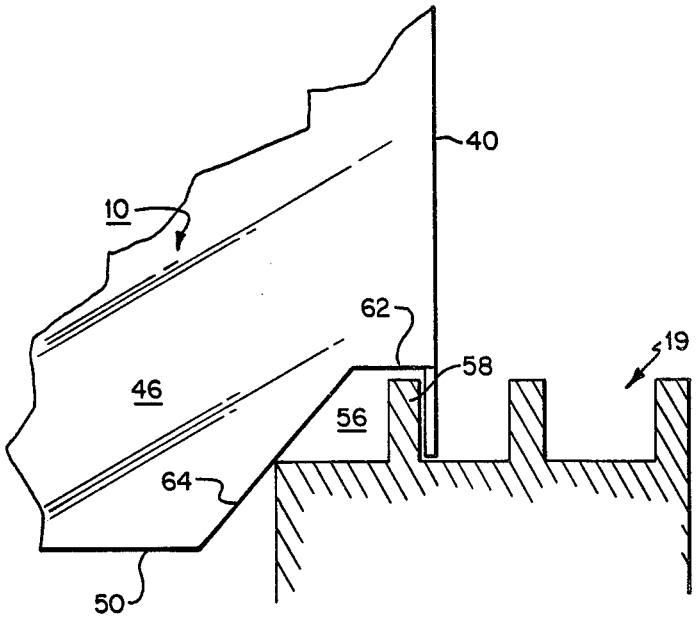
FIG. 6 is an enlarged, cross-sectional view of the notch portion of the rain guard of FIG. 4.

In the embodiment illustrated in FIGS. 1–6 the dome section 46 is provided with a notched section 56 adjacent the bottom of each vertical flanges 40, 42. The notched section 56 depending on the configuration of the sil of the storm window can assist in providing two very useful functions. First, it provides clearance with an upstanding lip 58 which is often present on bottom support 19 of the triple track storm window 12 so that the bottom edges of vertical flanges 40, 42 can extend below the bottom support 19 of frame 16. Notched section 56 also assists to securely position the rain guard 16 within the storm window 12. In the particular embodiment illustrated, the notched section 56 comprises a horizontal surface 62 and an angled surface 64. When the rain guard 10 is properly installed in storm window 12, the horizontal surface 62 will contact with the upstanding lip 58 of bottom support 19 of frame 16 as illustrated in FIG. 6 (FIG. 6 being an enlarged partial view of FIG. 4). It is to be understood that the notched section 56 may take various other shapes.

Figure 7:
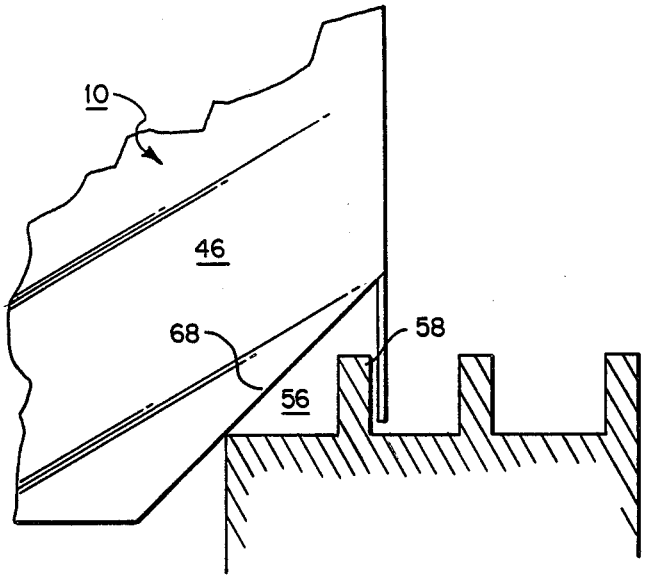
FIG. 7 is an enlarged, cross-sectional view of a modified notch section of a rain guard made in accordance with the present invention.
Figure 10:
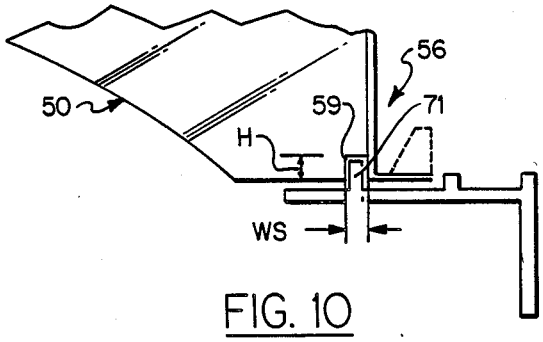
FIG. 10 is illustrated as an enlarged side elevational sectional view of a rain guard made in accordance with the present invention having a modified notched section.

Referring to FIG. 7, there is illustrated an alternate configuration which notched section 56 may take. In this embodiment, the notched section 56 comprises a single angled surface 68 which contacts the bottom lip 58 of frame 16. By providing a single angled surface 68, various different sizes of frames can be easily accommodated. Referring to FIG. 10 there is a rain guard made in accordance with the present invention having modified shaped notched section 56 comprises a substantially rectangular shaped slot 59. In this embodiment slot 59 is shaped to have a width WS greater than the width of rail 71 and height H slightly greater than the thickness of the rail 71. The width WS will typically range from about 1/16 inches to about 3/16 inches. It is to be understood the notched section can take a variety of sizes and shapes to accommodate the many different storm window configurations that exist. Additionally, notched section may be entirely omitted as illustrated in FIG. 11.

As previously noted, the rain guard 10 of the present invention is made of a single unitary piece of any suitable plastic. In the embodiment illustrated the body is made of a polycarbonate plastic. Preferably, the rain guard 10 is vacuum formed, however, it may be made in any other manner so desired. The flanges 40, 42, 44, and dome section 46 have a cross-sectional thickness T such that the body is sufficiently rigid such that it can maintain its shape and configuration, yet is flexible enough such that it can be flexed a sufficient amount to provide easy installation within storm window 12. Preferably, the cross-sectional thickness T of the body is in the range of 0.01 to 0.25 inches. In the particular embodiment illustrated, the thickness T is approximately 0.035 inches. In some situations, the width of middle track 20 may be greater than the thickness T of flanges such that a small gap is present. Referring to 13 there is illustrated an enlarged cross-sectional view of the lower portion of a modified rain guard 10 mounted in the center track of a storm window. A small gasket 47 in the shape of a hollow elastic tube (for example, of about 0.25 inch in diameter) is placed between the flanges 40, 42, and the track 20 to firmly seat the rain guard 10 within frame 16. This space may be filled by alternative means. For example, the bottom edge of flanges 40, 42 may be bent over to fill up the space between the tracks as is illustrated in FIG. 10 which illustrates a modified form of the present invention. In like manner, the sides of vertical flanges 40, 42 can also be bent over to fill any space present.

Referring to FIG. 3, there is illustrated a rain guard 10 prior to installation. As illustrated therein, the rain guard 10 is provided with a plurality of score lines 70 which provide a weaken area wherein the flanges may be easily severed. This can be easily accomplished by bending the appropriate flange at the desired score line 70 back and forth or by cutting along the score line with a pair of scissors or other suitable cutting instrument. Thus, the width of the rain guard 10 flanges may be modified so that the width W of rain guard 10 corresponds to the appropriate dimensions required for a storm window which is to be used. Typically, width W would be slightly less than the distance D between vertical supports 21, 23 of middle track 20 of frame 16. Preferably, the score lines 70 are placed at appropriate positions such that they correspond to standard size storm windows. However, the rain guard 10 may be used with unstandard size storm window. As previously noted, the thickness T of the body is selected such that its is relatively thin. Thus, if necessary, the rain guard may be cut at any point along the flange, for example, between score lines 70 to accommodate the appropriate size storm window.

The rain guard 10 can be easily installed or removed from storm window 12. First, the screen 24 and storm window 26 are raised up a sufficient distance to allow placement of rain guard 10 therein. The rain guard 10 is inserted so that the flanges 40, 42 will fit between track 20 of storm window 12. After placement within track 20, rain guard 10 is pushed down as far as it can go. Thereafter, the storm window 26 is brought down to contact upper edge 45 of top flange 44. Then, the screen 24 can be lowered to function as a screen in its normal position while the rain guard 10 is in place. Since permanent window 14 has not been used in any way to mount rain guard 10, window 14 can be secured in the normal manner without the need to remove the rain guard 10. Thus, the rain guard 10 may be kept in place for an extended time period, for example, the entire summer season. Once installed all that is necessary to do to allow air to enter is to raise the lower half of window 14 thus allowing air to pass through access opening 47 and through screen 24. The rain guard 10 is easily removed by raising storm window 26 and removing rain guard 10.

Figure 8:
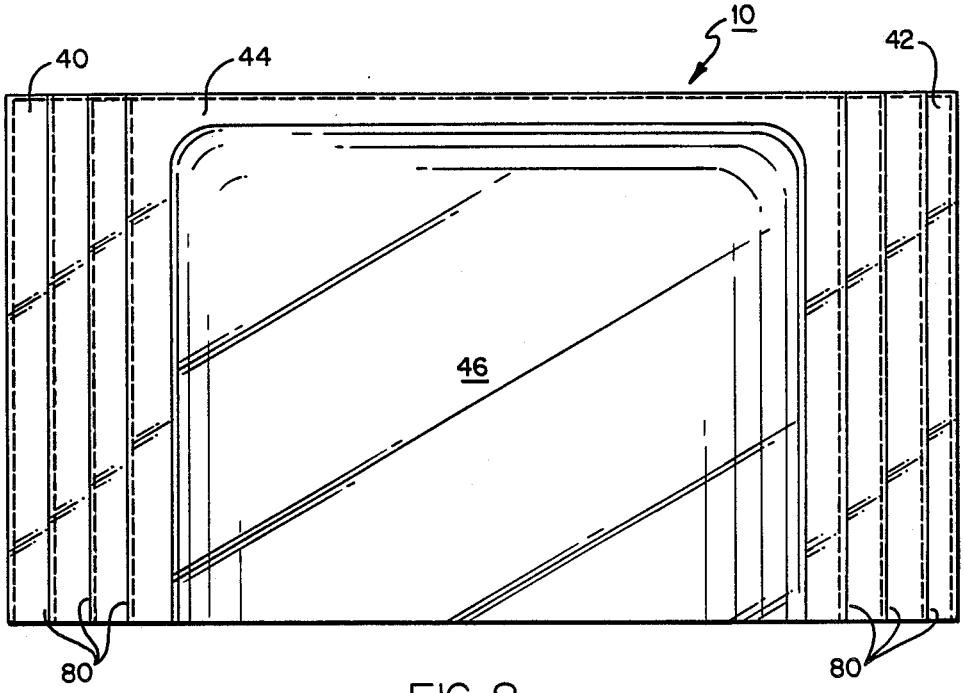
FIG. 8 is a front elevational view of the modified rain guard made in accordance with the present invention.
Figure 9:
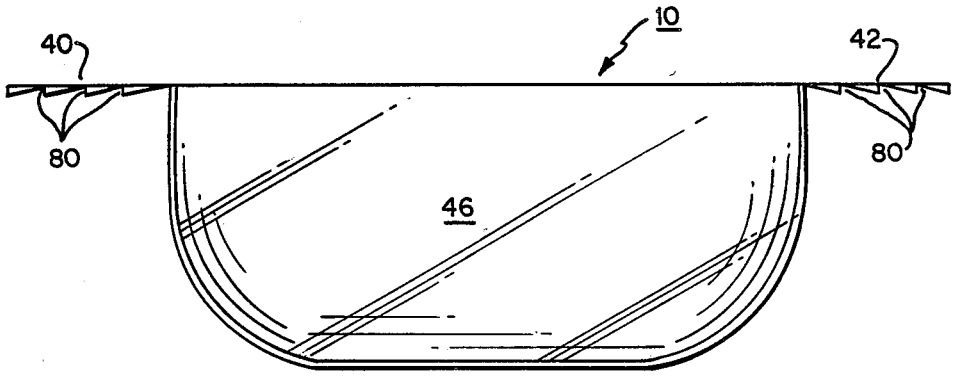
FIG. 9 is a bottom plan view of the rain guard of FIG. 8.

Referring to FIGS. 8 and 9, there is illustrated a modified rain guard 10 made in accordance with the present invention, like numerals indicating like parts. In this embodiment, instead of flanges 40, 42 being provided with score lines, each flange 40, 42 is configured to have a variable thickness along its width as illustrated in FIG. 9. The narrow thin areas 80 provide convenient locations for easy separation by cutting or by bending.

It is to be understood that various other modifications may be made to the present invention without departing from the scope of the present invention. The following claims defining the scope of protection of the present invention.

What is claimed is:

1. A rain guard for use with a triple track storm window comprising a generally rectangular unitary body made of a plastic material having a top edge, a bottom edge and a pair of axially spaced side edges, said body having a vertical flange along each of said side edges, a top flange along its top edge and a dome section extending from said flanges outwardly towards said bottom edge of said body terminating in a bottom edge and forming an access opening, said vertical flanges being designed to fit within one of the tracks of a triple track storm window, said vertical flanges terminating in lower edges, said vertical flange being disposed substantially in the same plane for placement within a single track of a triple track storm window.

2. A rain guard according to claim 1 wherein said body is made of a clear plastic material.

3. A rain guard according to claim 1 wherein said body is made of polycarbonate.

4. A rain guard according to claim 1 wherein said body has a thickness in the range of 0.01 to 0.25 inches.

5. A rain guard according to claim 1 wherein said body has a thickness of about 0.035 inches.

6. A rain guard according to claim 1 wherein said dome section has a notched section adjacent each of said vertical flanges.

7. A rain guard according to claim 1 wherein said notched section comprises a horizontal surface and adjacent said vertical flange an angles surface connecting said horizontal surface to the bottom edge of said dome.

8. A rain guard according to claim 1 wherein said notched section comprises a single angled surface connecting said vertical flanges to the bottom edge of said dome.

9. A rain guard according to claim 1 wherein said vertical flanges are provided with weakened areas to allow for easy cutting of said vertical flanges.

10. A rain guard according to claim 9 wherein said weakened areas are score lines.

11. A rain guard according to claim 1 wherein said vertical flanges each have a thickness which varies along its width which provides weakened areas for allowing easy cutting of separation of the flange at said point.

12. A triple track storm window and rain guard assembly comprising:

a substantially rectangular frame, said frame having an inner track, a middle track and an outer track for receiving either a storm window or a screen slidably mounted therein; and a rain guard for placement in said tracks of said triple track storm window, said rain guard comprising a generally rectangular unitary body portion made of a plastic material having a top edge, a bottom edge and a pair of axially spaced side edges, said body having a vertical flange along said each of side edges, a top flange along its top edge and a dome section extending from said flanges outwardly towards the bottom edge of said body terminating in a bottom edge and forming an access opening, said vertical flanges being designed to fit within one of the tracks of a triple track storm window.

13. A rain guard according to claim 12 wherein said body is made of clear plastic material.

14. A rain guard according to claim 12 wherein said body has a thickness in the range of 0.01 to 0.25 inches.

15. A rain guard according to claim 12 wherein said body has a thickness of about 0.035 inches.

16. A rain guard according to claim 12 wherein said dome section has a notched section adjacent each of said vertical flanges.

17. A rain guard according to claim 16 wherein said notched section comprises a horizontal surface and adjacent said vertical flange an angle surface connecting said horizontal surface to the bottom edge of said dome.

18. A rain guard according to claim 16 wherein said notched section comprises a single angle angled surface connecting each of said vertical flanges to the bottom edge of said dome.

19. A rain guard according to claim 12 wherein said vertical flanges are provided with weakened areas to allow for easy cutting of said vertical flanges.

20. A rain guard for use with a triple track storm window comprising a generally rectangular unitary body made of a plastic material having a top edge, a bottom edge and a pair of axially spaced side edges, said body having a vertical flange along each of said side edges, a top flange along its top edge and a dome section extending from said flanges outwardly towards said bottom edge of said body terminating in a bottom edge and forming an access opening, said vertical flanges being designed to fit within one of the tracks of a triple track storm window, said vertical flanges terminating in lower edge, said vertical flange being disposed substantially in the same plane for placement within a single track of a triple track storm window, said vertical flange having terminal lower ends which being disposed within same track as said vertical flanges.

21. A rain guard according to claim 20 wherein said body is made of a clear plastic material.

22. A rain guard according to claim 20 wherein said body is made of polycarbonate.

23. A rain guard according to claim 20 wherein said body has a thickness in the range of 0.01 to 0.25 inches.

24. A rain guard according to claim 20 wherein said body has a thickness of about 0.035 inches.

25. A rain guard according to claim 20 wherein said notched section comprises a horizontal surface and adjacent said vertical flange an angled surface connecting said horizontal surface to the bottom edge of said dome.

26. A rain guard according to claim 20 wherein said notched section comprises a single angled surface connecting said vertical flanges to the bottom edge of said dome.

27. A rain guard according to claim 20 wherein said vertical flanges are provided with weakened areas to allow for easy cutting of said vertical flanges.

28. A rain guard according to claim 27 wherein said weakened areas are score lines.

29. A rain guard according to claim 20 wherein said vertical flanges each have a variable thickness which varies along its width which provides weakened areas for allowing easy cutting or separation of the flange at said weakened areas.

30. A triple track storm window and rain guard assembly comprising:

a substantially rectangular frame, said frame having an inner track, a middle track and an outer track for receiving either a storm window or a screen slidably mounted therein; and a rain guard for placement in said tracks of said triple track storm window, said rain guard comprising a generally rectangular unitary body portion made of a plastic material having a top edge, a bottom edge and a pair of axially spaced side edges, said body having a vertical flange along said each of side edges, a top flange along its top edge and a dome section extending from said flanges outwardly towards the bottom edge of said body terminating in a bottom edge and forming a access opening, said vertical flanges being designed to fit within one of the tracks of a triple track storm window, said bottom edge of said dome extends to a point which corresponds to approximately the bottom of said vertical flange, said dome section having a notched section at its lower end adjacent said vertical flanges.

31. A rain guard according to claim 30 wherein said body is made of a clear plastic material.

32. A rain guard according to claim 30 wherein said body has a thickness in the range of 0.01 to 0.25 inches.

33. A rain guard according to claim 30 wherein said body has a thickness of about 0.035 inches.

34. A rain guard according to claim 30 wherein said notched section comprises a horizontal surface and adjacent said vertical flange an angled surface connecting said horizontal surface to the bottom edge of said dome.

35. A rain guard according to claim 30 wherein said notched section comprises a single angled surface connecting said vertical flanges to the bottom edge of said dome.

36. A rain guard according to claim 30 wherein said vertical flanges are provided with weakened areas to allow for easy cutting of said vertical flanges.

37. A rain guard for use with a triple track storm window comprising a generally rectangular unitary body made of a plastic material having a top edge, a bottom edge and a pair of axially spaced side edges, said body having a vertical flange along each of said side edges, a top flange along its top edge and a dome section extending from said flanges outwardly towards said bottom edge of said body terminating in a bottom edge and forming an access opening, said vertical flanges including means for being adjusted to be fitted within one of the tracks of a triple track storm window.

* * * * *